United States Patent [19]

Dickie

[11] Patent Number: 4,927,376

[45] Date of Patent: May 22, 1990

[54] ELECTRICAL PLUG ASSEMBLY AND SYSTEM

[75] Inventor: Robert G. Dickie, Newmarket, Canada

[73] Assignee: Paige Manufacturing Company Incorporated, New Market, Canada

[21] Appl. No.: 353,092

[22] Filed: May 17, 1989

[51] Int. Cl.[5] ..... H01R 19/04

[52] U.S. Cl. ..... 439/484; 439/694

[58] Field of Search ..... 439/484, 694, 172, 103, 439/107, 599, 92, 628, 135, 602, 21

[56] References Cited

U.S. PATENT DOCUMENTS

| | | | |
|---|---|---|---|
| 1,699,722 | 1/1929 | Stott | 439/484 |
| 1,846,251 | 2/1932 | Donahue | 439/694 |
| 1,978,805 | 10/1934 | McCloy et al. | 439/599 |
| 2,301,258 | 11/1942 | Corlew | 439/694 |
| 2,542,609 | 2/1951 | Wyglendowski | 439/694 |
| 2,855,578 | 10/1958 | Hirsch | 439/135 X |
| 2,892,172 | 6/1959 | McGann, Jr. | 439/135 |
| 3,975,075 | 8/1976 | Mason | 439/694 X |
| 4,026,618 | 5/1977 | Straka | 439/21 |
| 4,771,367 | 9/1988 | Serr et al. | 439/622 |
| 4,857,013 | 8/1989 | Peters | 439/484 |

FOREIGN PATENT DOCUMENTS

| | | | |
|---|---|---|---|
| 2563383 | 10/1985 | France | 439/484 |

*Primary Examiner*—William Briggs

*Attorney, Agent, or Firm*—Robert O. Nimtz

[57] ABSTRACT

A low profile alternating current electrical plug is disclosed in which the electrical pins are terminated in lands at right angles to the axis of the pins. These lands are used for crimping wires to the pins as well as for mechanically stabilizing the pins in the molded plug body. Forming these lands at right angles to the pin axis permits a very thin plug body. The electrical cord exits the plug head at an acute angle to the line of the power pins as well as at an acute angle to the axis of a mating electrical outlet. The wires exit the plug head, however, at a right angle to the pin axes and parallel to the wall, thereby maintaining the low profile.

At the wire exit, a cone-shaped sleeve acts as a shock absorber for forces exerted on the cord, thereby absorbing most of these forces before they reach the pin area. A removal ring is made integral with the low profile plug, lying parallel to the plug when not in use, but pivoting to a perpendicular position when grasped by a finger. Due to the low profile of the plug and the wall-hugging position of the cord, decorative covers can be installed over both the wire and the plugs, making the entire electrical installation aesthetically appealing.

7 Claims, 3 Drawing Sheets

FIG. 6
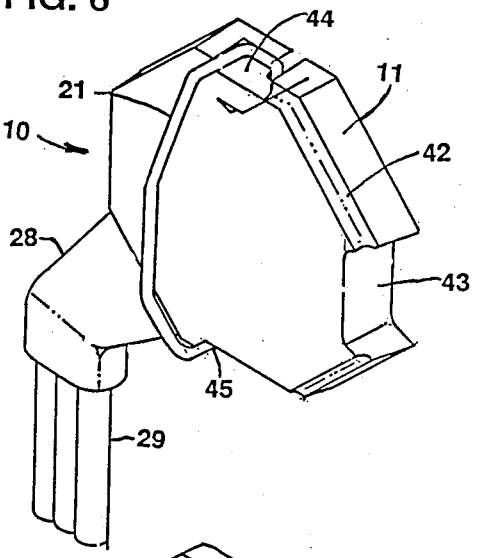
FIG. 7
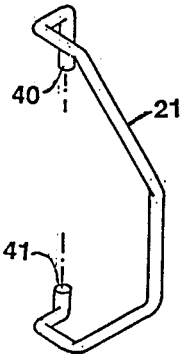
FIG. 8
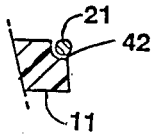
FIG. 9
FIG. 10
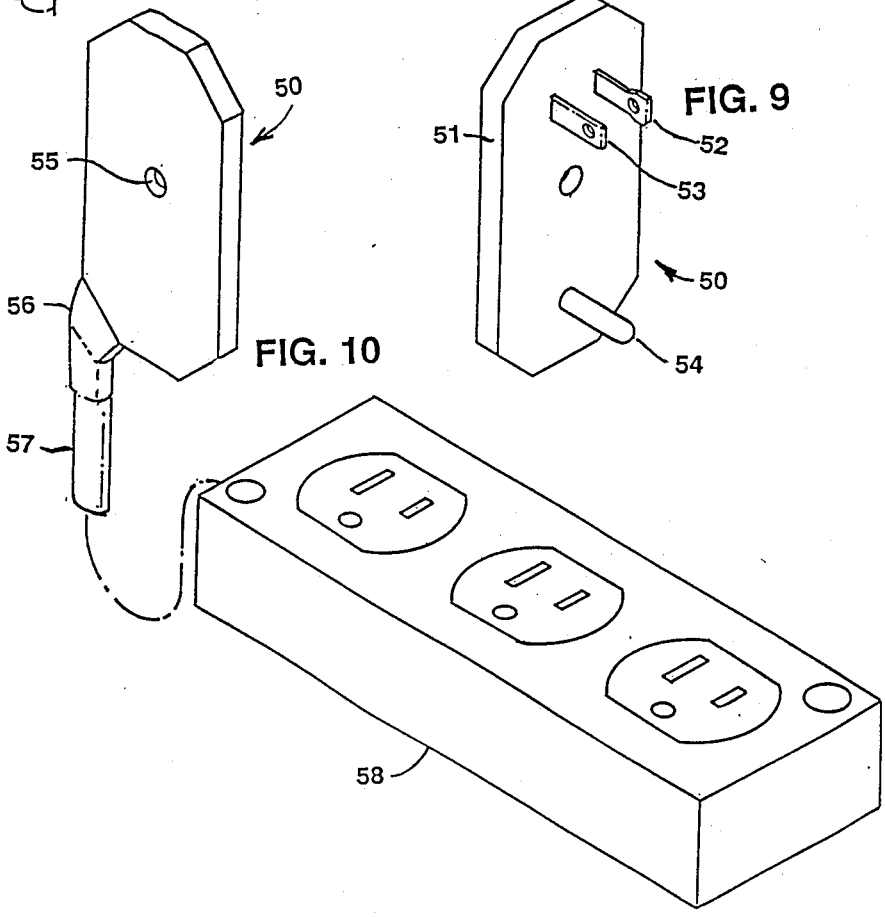

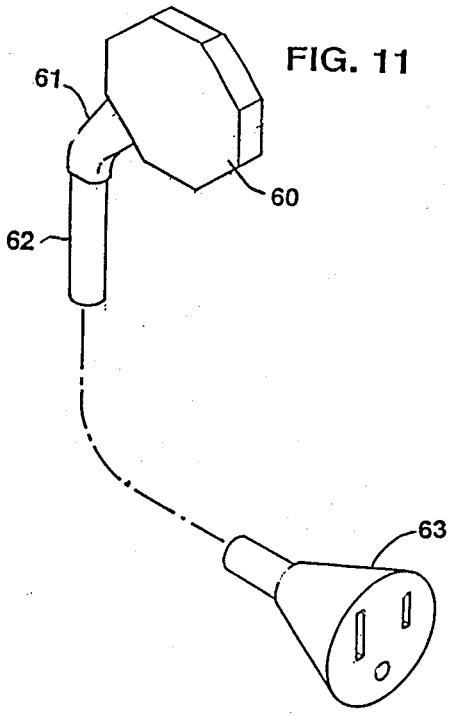
FIG. 11
FIG. 12
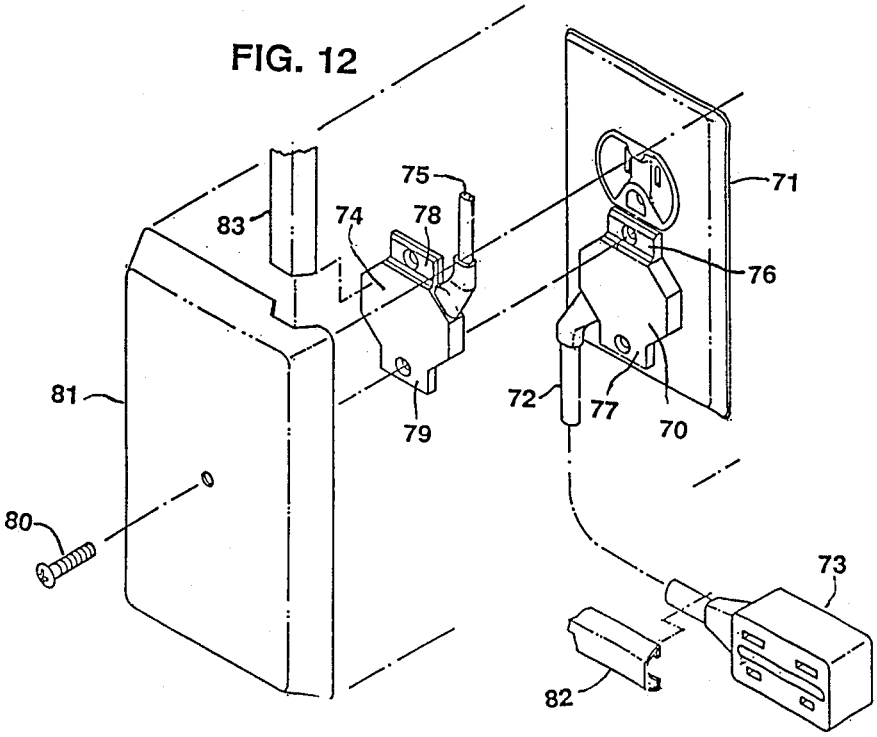

ELECTRICAL PLUG ASSEMBLY AND SYSTEM

TECHNICAL FIELD

This invention relates to electrical distribution systems and, more particularly, to improved low profile electrical plugs for use in such systems.

BACKGROUND OF THE INVENTION

The proliferation of electrical appliances, lighting fixtures and electronic entertainment devices has brought with it a rapid increase in the number of electrical line cords and electrical extension cords necessary to service these appliances and devices. It has therefore become increasingly necessary to multiply the number of connections made to standard electrical wall outlets, using extension cords or outlet multiplying devices plugged directly into the wall outlet. While these arrangements provide the necessary multiplication of outlets, the resulting "rat's nest" of wires and plugs is unsightly and sometimes dangerous. Moreover, if a wall outlet is located behind a piece of furniture, it becomes impossible to push the piece of furniture flush against the wall. This leaves an unsightly opening at the rear edge of the piece of furniture into which items can easily fall and from which it is most difficult to retrieve such items.

The advent of grounded outlets, using a third ground socket, aggravates the outlet multiplication problem since the need for a third pin on the plug tends to make the plug bulkier. Moreover, the orientation of the ground socket often makes it difficult or impossible to plug more than one grounded plug into a standard double wall outlet. If the plug makes a right-angled turn at the outlet along a vertical line, for example, only one plug can be inserted into the double outlet due to the interference it causes with a second grounded plug, whether in the bottom or the top socket.

SUMMARY OF THE INVENTION

In accordance with the illustrative embodiment of the present invention, these and other problems are overcome by means of an alternating current electrical plug with a very low profile and with a wire exiting from the plug at right angles to the wall, but at an acute angle to the axis of a double outlet. The low profile and the right angle exit permits furniture to be positioned close to the wall while the acute angle the exiting cord makes with the outlet axis permits both outlets of a double grounded outlet to be used without mutual interference.

More specifically, the wire connection end of the power pins and the ground pin of the plug are formed with integral wide flat stabilizer areas perpendicular to the axes of the pins and parallel to the wall. This wide flat stabilizer area serves to hold the pin firmlly in the relatively thin plug depth. Similarly, the wire connection to the pin is made with a flat wire crimping land which is also perpendicular to the axis of the pin and parallel to the wall. The crimp is made toward the face of the plug since the thickness of the electrically insulative covering plug material is not as critical on this side as it is on the rear of the plug facing the user.

One major advantage of the present invention is the low profile of the resulting plug. A second advantage is the fact that the connecting wires exit from the plug at a right angle to the axis of the pins, thereby maintaining the low profile. A third advantage of the present invention is the fact that the connecting wires exit from the plug at an acute angle to the axis of a double outlet, thereby permitting both outlets of the double outlet to be used.

In accordance with one feature of the present invention, the point of exit of the wires from the plug comprises a cone-shaped sleeve surrounding the wires, which cone-shaped sleeve acts as a shock absorber for forces exerted on the line cord, minimizing the transfer of these forces to the internal parts of the plug. This feature is important because it allows the plug to be pulled out by a yank on the connecting electrical cord without damaging the plug, a requirement of many electrical codes.

In accordance with another feature of the present invention, a removal ring is provided which folds flat against the plug when not in use. Any attempt to remove the plug by grasping the thin, tapered edges of the plug, however, causes a finger to engage the removal ring which can then be used to safely remove the plug from the outlet without pulling on the electrical cord. This is also a requirement of many electrical codes.

In accordance with yet another feature of the invention, the extremely flat, thin profile of the electrical plugs of the present invention permit the entire wall outlet to be covered with a flat cover plate which can be painted or wall-papered to match the decor of the wall. Flat wire snap-on channels over the wall-hugging wires exiting from the plug complete an almost invisible electrical installation. Outlets at the end of an extension cord can be hidden under furniture, possibly affixed to the underside of such furniture by VELCRO ® pads on the back of the extended outlets.

BRIEF DESCRIPTION OF THE DRAWINGS

A complete understanding of the present invention may be gained by considering the following detailed description in conjunction with the accompanying drawing, in which:

FIG. 6 shows a perspective view of the low profile plug of the present invention showing the wire exit sleeve and details of the plug removal ring;

FIG. 7 is a perspective view of the plug removal ring;

FIG. 8 is a partial cross-sectional view of the plug edge showing the retaining detent for the plug removal ring;

FIG. 9 is a perspective view of a low profile electrical plug designed to cover the entire faceplate of a standard double wall outlet;

FIG. 10 is a perspective view of an extension cord using the plug of FIG. 9;

FIG. 11 is a perspective view of a simple extension cord using a low profile electrical plug in accordance with the present invention; and FIG. 12 is aperspective view of two low profile electrical plugs in accordance with the present invention in a double wall outlet showing the use of decorative covers over the entire outlet and the wires extending therefrom.

To facilitate reader understanding, identical reference numerals are used to designate elements common to the figures.

DETAILED DESCRIPTION

Figure 1:
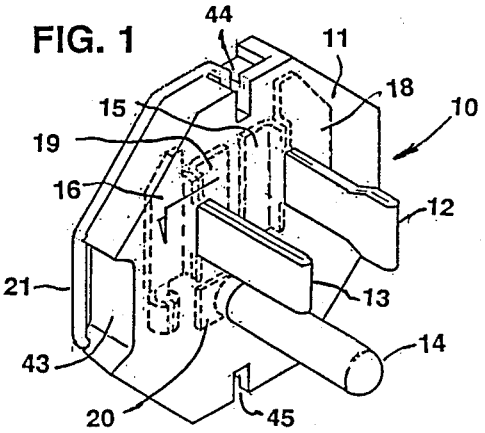
FIG. 1 shows a perspective view of an electrical plug in accordance with the present invention.
Figure 2:
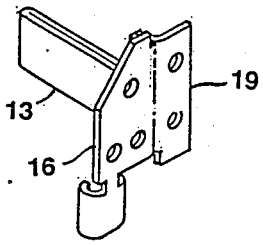
FIG. 2 shows a perspective view of one of the power pins of the flat plug shown in FIG. 1, showing the wide flat areas provided for pin stability in the flat plug and also showing the wire crimping land connected to the power pin.
Figure 3:
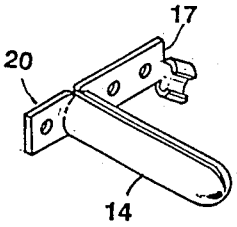
FIG. 3 shows a perspective view of the ground pin of the flat plug shown in FIG. 1, also including a wide flat stabilizer areas and a wire crimping land.

Referring more particularly to FIG. 1, there is shown a perspective view of a low profile alternating current electrical plug 10 in accordance with the present invention comprising a body portion 11 composed of polyvinylchloride (PVC) having a durometer rating of over 90, or a highly insulative plastic alloy such as LEXAN ®, or any other tough but somewhat flexible insulative material. Embedded in body portion 11 are the ends of two conductive power pins 12 and 13 and a conductive ground pin 14. The embedded ends of pins 12, 13 and 14 have wide flanged areas on both sides of the pins at right angles to the axis of the pins. Power pins 12 and 13 can be polarized, as shown, by providing a flared tip for pin 12 and a non-flared tip for pin 13. Wire crimping lands 15, 16 and 17 are formed at right angles on one side of pins 12, 13 and 14, respectively, while stabilizing lands 18, 19 and 20 are formed at right angles on the other side of pins 12, 13 and 14, respectively. The function of the stabilizing lands is to provide a substantial surface area in contact with the insulative material of body portion 11 on each side of pins 12–14, thereby improving the mechanical stability of the pins 12–14 in the body of plug 10. As can be better seen in FIG. 2, the stabilizing land 19 of pin 13, as well as the wire-crimping land 16 are perforated with holes. These holes further increase the mechanical stability of the assembly by allowing the insulative material to flow into these holes during molding and thereby provide an integral structure of the plastic material of the body and the conductive material of the pins. A plug removal ring 21 is designed to lie flat in a recess on the outer edge of body portion 11. When engaged by the finger, ring 21 pivots out to form a ring which can be used to remove the plug 10 form the wall outlet.

The pins 12 and 13 are stamped from metal sheet material to form strips which can then be bent back on themselves so that the stabilizer lands can be formed at right angles to the bent back strip on one side while the wire crimping land can be formed at right angles to the bent back strip on the other side. The power wire insulation is stripped back to expose the conductor wires which are then crimped to the crimping lands 15, 16 and 17. Finally the body 11 of the plug is over-molded around these pins in a plastic injection mold, thereby insuring intimate contact and mechanical stability. The resulting structure is shown in cross-section in FIG. 4.

Figure 4:
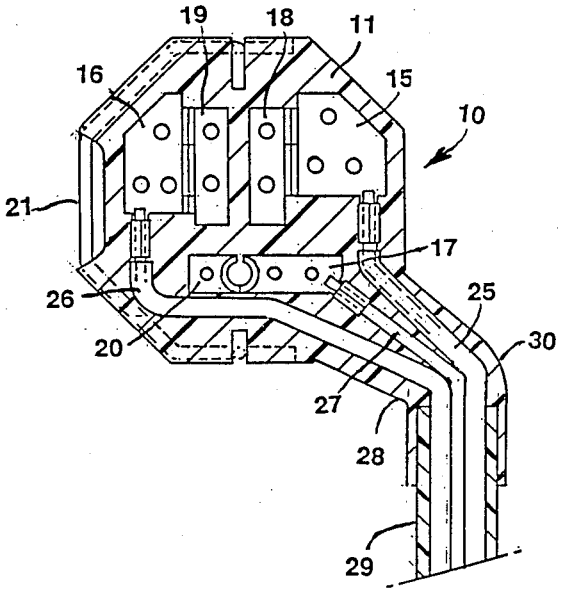
FIG. 4 shows a cross-sectional view of the plug of FIG. 1 in the plane of the plug, showing details of the stabilizing areas, the wire crimping lands, the plug removal ring, and the wire exit sleeve.

Referring then to FIG. 4, the ends of alternating current power wires 25 and 26 are stripped of insulation and crimped to the crimping lands 15 and 16, respectively, and the ground wire 27, which need not be insulated, is crimped to the crimping land 17. The wires 25, 26 and 27 are and gathered together to exit from plug 10 at an acute angle to both the axial lineup of the power pins 12 and 13 and at an acute angle to the axial lineup of the double wall outlet into which plug 10 is to be plugged. Surrounding the exiting wires is a cone-shaped sleeve 28 which has a greater diameter near body portion 11 than near insulated electrical cord 29. Sleeve 28 also has a bend 30 which realigns the cord 29 with the axis of the outlets, but sufficiently far away from the outlet axis to prevent interference with another similar plug which is plugged into the other outlet of a double wall outlet.

Figure 5:
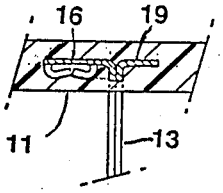
FIG. 5 shows a partial cross-sectional view of the plug of FIG. 1 perpendicular to the plane of the plug, showing the details of one of the pin ends embedded in the plug material.

In FIG. 5 there is shown a partial cross-sectional view of the embedded end of one of the power pins, pin 13. As can be seen in FIG. 5, the wire crimping land 16 is oriented such that the crimp is facing the inner face of body 11. A flat crimp is used instead of a round barrel crimp to minimize the thickness of the completed crimp. Since the thickness of the body 11 in the area of the crimp land 16 must be thicker towards the back or user face of the low profile plug, than towards the front or outlet face, the crimp is oriented on the front or outlet face and closer to the outlet face than the user face.

Referring to FIG. 6, there is shown another perspective view of the low profile electrical plug 10 of the present invention showing the details of the removal ring. The removal ring 21 is shown by itself in FIG. 7. As can best be seen in FIG. 7, the removal ring 21 pivots around an axis formed by the ends 40 and 41 of ring 21. Ends 40 and 41 can be sprung apart to permit inserting these ends into mating holes in body 11 (not shown) which act as bushings for rotation of the removal ring 21. As can be seen in the partial cross-sectional view of the edge of plug 10 in FIG. 8, the ring 21, when not in use, is retained in a quarter-round detent cutout 42 in body 11. Moreover, a cutout 43 in the body 11 permits the finger tip to easily get under removal ring 21 when it is desired to remove the plug 10. Removal ring 21 may be vinyl coated to improve its appearance and comfort when used. Right angled pockets 44 and 45 maintain removal ring 21 at a right angle to the plane of plug 10 when the ring 21 is open and in use. It can also be seen in FIG. 8 that the narrow peripheral edges of the plug 10 are tapered slightly away from the front edge. This taper makes grasping the plug by its edges very difficult and thereby facilitates engagement with the removal ring 21.

The shock absorbing cone-shaped sleeve 28 connecting plug 10 to electrical cord 29 can also be seen in FIG. 6. It is clear that pulling, yanking or tugging cord 29 must first distort sleeve 28 before these forces can be transmitted to plug body 11. The sleeve 28 therefore acts as a shock absorber in that sharp transient forces on cord 29 caused, for example, by tripping over the cord 29, are initially absorbed in bending and distorting sleeve 28, and only then are transmitted to the body 11 of the plug 10. This shock absorbing function of sleeve 28 minimizes the effect of such transient forces on the operating parts of the plug 10, i.e., the pins 12, 13 and 14 and the wires 25,26 and 27.

Referring to FIG. 9, there is shown a perspective view of another species of low profile electrical plug in accordance with the present invention. The low profile plug 50 of FIG. 9 comprises a body portion 51 designed to extend over and cover both outlets of a standard double wall outlet. The power pins 52 and 53 are designed to fit into the power sockets of one of the outlets while the ground pin 54 is designed to fit into the ground socket of the other outlet of the double wall outlet. The low profile plug 50 therefore conceals the entire wall outlet.

In FIG. 10 there is shown an extension cord using the double outlet plug 50 of FIG. 9. The plug 50 has a hole 55 through which a screw can be threaded to engage the threads in the standard threaded hole at the center of the double wall outlet. Plug 50 has a sleeve 56, exiting at an acute angle to the axis of the double outlet, and connecting to wire cord 57. A multi-outlet receptacle 58 is connected to the other end of cord 57. Receptacle 58 can be laid on the floor under furniture or can have a VELCRO ® pad attached to the rear side thereof for attachment to the underside of the furniture itself. In either event, the unsightly multiple outlet receptacle is out of sight.

In FIG. 11, there is shown a low profile plug 60 attached through sleeve 61 and electrical cord 62 to a single outlet receptacle 63. In FIG. 12 there is shown yet another version of low profile electrical plug in accordance with the present invention. A first low profile plug 70 is inserted into the lower outlet of standard double wall outlet 71. The electrical cord 72 is connected to a standard extension cord receptacle 73. A second low profile plug 74 can be inserted into the upper outlet of double wall outlet 71 to connect a second extension cord 75 to another position requiring electrical service, for example, to light a picture on the wall. Note that the connecting cord 75 exits from plug 74 upwardly to facilitate routing to appliances located above outlet 71.

As can be seen in FIG. 12, the low profile plugs 70 and 74 have upwardly and downwardly extending tabs 76, 77, 78, and 79 with holes therein to facilitate attachment to outlet 71 by screws. Moreover, tabs 77 and 79 are half the thickness of plugs 70 and 74 and are flush with the outer surface thereof. Tabs 76 and 78, on the other hand, are also half the thickness of the plugs 70 and 74, but are flush with the inner surface of plugs 70 and 74. These half thicknesses allow the tabs 76 and 78 to overlap and engage snugly, sharing the same mounting screw 80. A low profile decorative cover plate 81 can be assembled over both of the plugs 70 and 74 due to their low profile. Decorative snap-on channels 82 and 83 can be used to conceal the wire cords 72 and 75, respectively, using mitered corners at bends in the cords. In combination, the low profile plugs and decorative coverings of FIG. 12 form a pleasing, virtually invisible electrical distribution system.

It should also be clear to those skilled in the art that further embodiments of the present invention may be made by those skilled in the art without departing from the teachings of the present invention.

What is claimed is:

1. An alternating current low profile electrical plug assembly comprising a flat, low profile insulative plug body having a vertical axis, a plurality of conductive pins having a connector portion extending perpendicularly to said plug body for engagement with mating sockets in an electrical outlet, each of said pins including at least one stabilizing land area at right angles to said connector portion and embedded in said body, each of said pins including a wire connecting area also at right angles to said connector portion and embedded in said body, electrical wires connected to said pins and exiting said body at an acute angle to said vertical axis and a cone-shaped sleeve attached to said body and enclosing said electrical wires, said sleeve including a bend which realigns said electrical wires with said vertical axis.

2. The alternating current plug according to claim 1 wherein said stabilizing land area includes a plurality of holes for admitting the material of said plug body, under flow conditions for said material, in order to improve the positional stability of said conductive pins.

3. The electrical plug assembly according to claim 1 further comprising a removal ring pivotally attached to said body such that said ring is parallel to said body when not in use and perpendicular to said body when in use.

4. The electrical plug assembly according to claim 1 wherein said connecting area comprises a portion of said pin being bent back on itself to form a flat crimp to enclose said wires.

5. The electrical plug assembly according to claim 1 further comprising a decorative plate covering said plug body.

6. The electrical plug assembly according to claim 1 further comprising decorative wire channels covering said electrical wires.

7. The electrical plug assembly according to claim 1 wherein said plug body is in the shape of an octagon, and said wires exit from a face of said octagon at an acute angle to said vertical axis.

* * * * *